US006394450B2

(12) United States Patent
Kishine et al.

(10) Patent No.: US 6,394,450 B2
(45) Date of Patent: May 28, 2002

(54) APPARATUS FOR DELIVERY OF PRINTED SHEETS OF PAPER OR THE LIKE IN SUCCESSIVE STACKS

(75) Inventors: Toshiaki Kishine; Mikio Yoshikawa; Yuichi Yamazaki, all of Chiba (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 0 days.

(21) Appl. No.: 09/855,615

(22) Filed: May 16, 2001

(30) Foreign Application Priority Data

May 19, 2000 (JP) ..... 2000-148125

(51) Int. Cl.[7] ..... B65H 29/20

(52) U.S. Cl. ..... 271/315; 271/187; 271/218; 271/195

(58) Field of Search ..... 271/187, 315, 271/211, 195, 218

(56) References Cited

U.S. PATENT DOCUMENTS 2,014,933 A * 9/1935 Harless et al. ..... 271/315
5,630,584 A * 5/1997 Seeber ..... 271/315
6,019,209 A * 2/2000 Hara et al. ..... 271/315
6,059,283 A * 5/2000 Yoneda ..... 271/187
6,131,903 A * 10/2000 Schaefer et al. ..... 271/315
6,216,591 B1 * 4/2001 Nanba ..... 271/315
6,241,648 B1 * 6/2001 Uera et al. ..... 271/315

FOREIGN PATENT DOCUMENTS

JP 62-121176 6/1987

* cited by examiner

*Primary Examiner*—H. Grant Skaggs
(74) *Attorney, Agent, or Firm*—Wenderoth, Lind & Ponack, L.L.P.

(57) ABSTRACT

A delivery fan, comprising sets of blades at constant circumferential spacings, receives therebetween the sheets successively falling from an overhead infeed conveyor. The sheets fall off the delivery fan on hitting a set of abutment tines arranged interdigitatingly with the fan blades. A stack of sheets thus formed on a retractable platform is unloaded therefrom onto a delivery conveyor. A temporary sheet holder is provided which is angularly displaceable about the delivery fan axis between a working position, where it temporarily receive the sheets falling off the delivery fan pending unloading of the preformed stack of sheets, and a retracted position where the sheet holder allows the sheets to fall from the delivery fan onto the platform. The sheet holder is mounted to the shaft of the delivery fan via a pair of overrunning clutches and sprung from the retracted toward the working position. Consequently, when unlocked from its retracted position upon stacking of the sheets to a predetermined height on the platform, the sheet holder turns to the working position at the same angular velocity as the delivery fan.

6 Claims, 9 Drawing Sheets

APPARATUS FOR DELIVERY OF PRINTED SHEETS OF PAPER OR THE LIKE IN SUCCESSIVE STACKS

BACKGROUND OF THE INVENTION

This invention relates to an apparatus for rearranging sheets of paper or like material into stacks. Typically, the apparatus is incorporated with a printing press for delivery of printed sheets of paper in successive stacks on a delivery conveyor.

A typical prior art apparatus in the field is disclosed in Japanese Unexamined Patent Publication No. 62-121176. It includes what is known to the specialists as a delivery fan, a rotor having axial rows of convolute blades mounted thereon at constant circumferential spacings. Issuing from a frictional belt conveyor system one by one, printed sheets of paper are successively received one in each spacing between the blades of the delivery fan in rotation. The sheets revolve with the delivery fan until, approximately half a revolution later, they comes into successive abutment against a set of stop blades which are arranged interdigitatingly with the fan blades. Thereupon, with the continued rotation of the delivery fan, the sheets will be pushed out of the fan blade spacings and, thus falling off the delivery fan, deposited upon an underlying tray to be stacked thereon.

Another important component of the delivery apparatus is a temporary sheet holder which is angularly displaceable radially outwardly of the delivery fan about the same axis therewith. When the sheets are stacked to a predefined height on the tray, the sheet holder will be turned to its working position between the delivery fan and the tray for temporarily receiving the sheets that are subsequently released from the fan. The sheet holder will be retracted away from under the delivery fan after the preformed stack on the tray has been carried away and a new tray positioned in its stead. The sheets that have been deposited on the sheet holder will fall off the same onto the new tray during the retraction of the sheet holder, and the sheets subsequent released from the delivery fan will fall onto the new tray and form another stack thereon.

An objection to this prior art apparatus is that the delivery fan and the temporary sheet holder are driven by different means comprising separate electric stepper motors. Difficulties have been experienced as a consequence in realizing strict synchronism in turning the sheet holder to its working position with the rotation of the delivery fan. In event the delivery fan and the sheet holder are driven out of synchronism, mutual interference has been easy to occur between the sheet holder and the sheets falling off the delivery fan. The frequent results have been the creasing or wrinkling of the sheets and the uneven or irregular stacking thereof.

Another objection concerns the way the sheets temporarily deposited on the sheet holder are subsequently dropped therefrom onto the new tray when the sheet holder is angularly retracted about the delivery fan axis. The lowermost one of the sheets on the sheet holder has tended to stick to it so fast that the lowermost sheet has often failed to come off the sheet holder being retracted, again resulting in disorderly or uneven stacking of the sheets.

SUMMARY OF THE INVENTION

The present invention has it as an object to realize exact synchronism in angular displacement of the temporary sheet holder to its working position with the rotation of the delivery fan.

Another object of the invention is to ensure that all the sheets that have fallen upon the temporary sheet holder smoothly come off the same upon its retraction.

Still another object of the invention is to avoid any interference between the sheets falling off the delivery fan and the sheet holder traveling to its working position.

Briefly, the present invention may be summarized as an apparatus for delivery of sheets of paper or like material in successive stacks, comprising a delivery fan for receiving successive sheets from some infeed means while in rotation in a prescribed direction. The delivery fan is provided with abutment means to be hit by the sheets being carried thereby, the sheets on hitting the abutment means falling off the delivery fan with continued rotation thereof, onto underlying delivery means to be stacked thereon. A temporary sheet holder is angularly displaceable about the same axis as the delivery fan between a working position, where the temporary sheet holder temporarily receives the sheets falling off the delivery fan pending replacement of a preformed stack of sheets on the delivery means, and a retracted position, spaced upstream from the working position with respect to the rotational direction of the delivery fan, where the temporary sheet holder allows the sheets to fall from the delivery fan onto the delivery means.

Characteristically, the temporary sheet holder is mounted to the shaft of the delivery fan via overrunning clutch means which prevent the temporary sheet holder from running faster than the delivery fan shaft from the retracted toward the working position, and which allow the temporary sheet holder to rotate independently of the delivery fan shaft from the working toward the retracted position. Resilient means act between the temporary sheet holder and a stationary part of the apparatus for biasing the former from the retracted toward the working position and hence for causing, in cooperation with the overrunning clutch means, the temporary sheet holder to travel at the same angular velocity as the delivery fan from the retracted to the working position. Drive means are provided for moving the temporary sheet holder from the working to the retracted position against the bias of the resilient means.

When the sheets falling from the delivery fan are being stacked on the delivery means, the temporary sheet holder is positively retained in the retracted position by the drive means. Then, unlocked from the retracted position upon stacking of a prescribed number of sheets on the delivery means, the temporary sheet holder tends to run faster than the delivery fan to the working position under the influence of the resilient means. Actually, however, the sheet holder is constrained by the overrunning clutch means to joint travel with the delivery fan at the same angular velocity therewith.

Exact synchronism is thus attained between delivery fan and temporary sheet holder. So driven to its working position, the sheet holder will seldom interfere with the sheets falling from the delivery fan, nor will an error easily occur in the number of sheets forming each stack.

Another feature of the invention concerns the construction of the temporary sheet holder itself. The sheet holder includes a set of sheet holder prongs spaced axially of the delivery fan and each extending circumferentially of the delivery fan. Each sheet holder prong is made hollow, defining a plenum chamber therein, and has a suitable number of air exit openings formed least in its surface facing the delivery fan and, preferably, in part of its other surface facing away from the delivery fan.

Air under pressure flows out all the openings in the sheet holder prongs at least when the sheet holder is traveling toward its working position. As the sheet holder enters between any two consecutive sheets falling from the delivery fan, the outflowing air will widen the space therebetween, making it all the more unlikely for the sheet holder to touch, much less wrinkle or otherwise damage, the sheets.

Air is also to be emitted from the sheet holder prong surfaces when the sheet holder is retracted from its working position. The sheets that have been deposited on the sheet holder during replacement of the preformed sheet stack are to fall by gravity from the sheet holder upon its retraction, in order to form another stack on the delivery means. There is no risk of the sheets remaining stuck to the sheet holder prong surfaces, and so being carried away to the retracted position of the sheet holder, as air issues from the perforated prong surfaces.

The above and other objects, features and advantages of the invention and the manner of realizing them will become more apparent, and the invention itself will best be understood, from the following description taken together with the attached drawings showing the preferred embodiment of the invention.

DESCRIPTION OF THE PREFERRED EMBODIMENT

General

Figure 1:
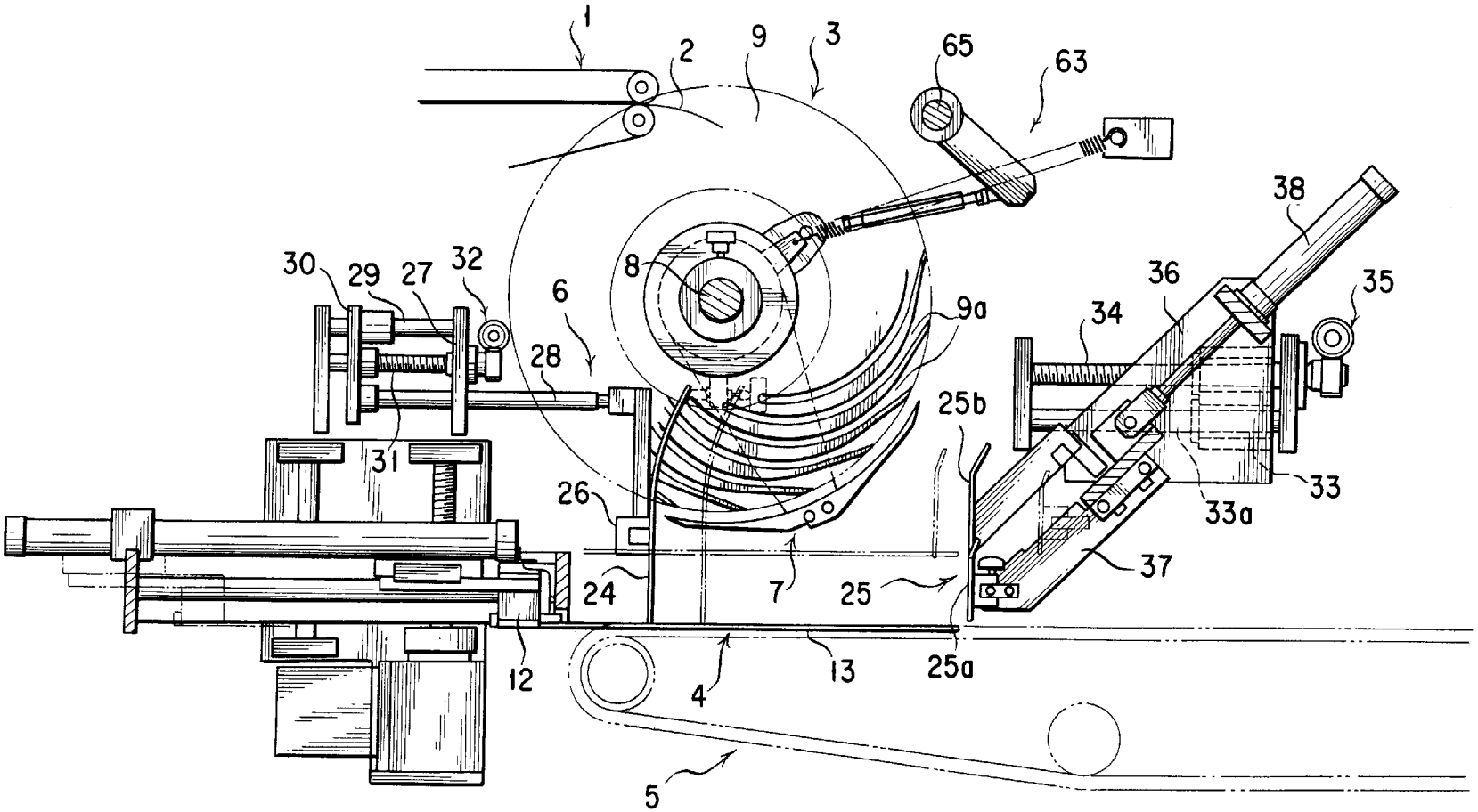
FIG. 1 is an explanatory side elevation, with parts shown in section and parts shown broken away for illustrative convenience, of the apparatus embodying the principles of this invention.

The general organization of the apparatus according to the invention, as adapted for stacked delivery of printed sheets in a printing press, will become apparent from a study of FIG. 1. It includes an infeed conveyor 1 shown as comprising two endless belts arranged face to face for frictionally engaging therebetween a row of printed sheets 2 to be delivered. Under the exit end of the infeed conveyor 1 there is rotatably mounted a delivery fan 3 for successively receiving the sheets 2 from the overhead conveyor. Itself of conventional make, the delivery fan 3 rotates in a prescribed direction, clockwise as viewed in FIG. 1, for carrying the received sheets downwardly.

Under the delivery fan 3 there is provided a platform 4, movable both vertically and horizontally, for having the sheets 2 deposited from the delivery fan and stacked thereon. Further underlying the movable platform 4 is a delivery conveyor 5 which, as each complete stack of sheets is transferred from the movable platform 4, carries the same away toward the next processing station. The sheets 2 falling from delivery fan 3 to movable platform 4 are guided by adjustable stacking guide means 6.

The reference numeral 7 generally denotes a temporary sheet holder for temporarily holding sheets while each complete stack of sheets is being unloaded from the platform 4 onto the delivery conveyor 5. The present invention particularly concerns the construction of this temporary sheet holder itself and the means for causing its angular displacement between working and retracted positions about the axis of the delivery fan 3.

Hereinafter in this specification the above noted delivery fan 3, movable platform 4 with its supporting and actuating means, adjustable stacking guide means 6, and temporary sheet holder 7 with its actuating means, will be discussed in more detail, in that order and under separate headings. Operational description will follow the discussion of the listed components.

Delivery Fan

Figure 2:
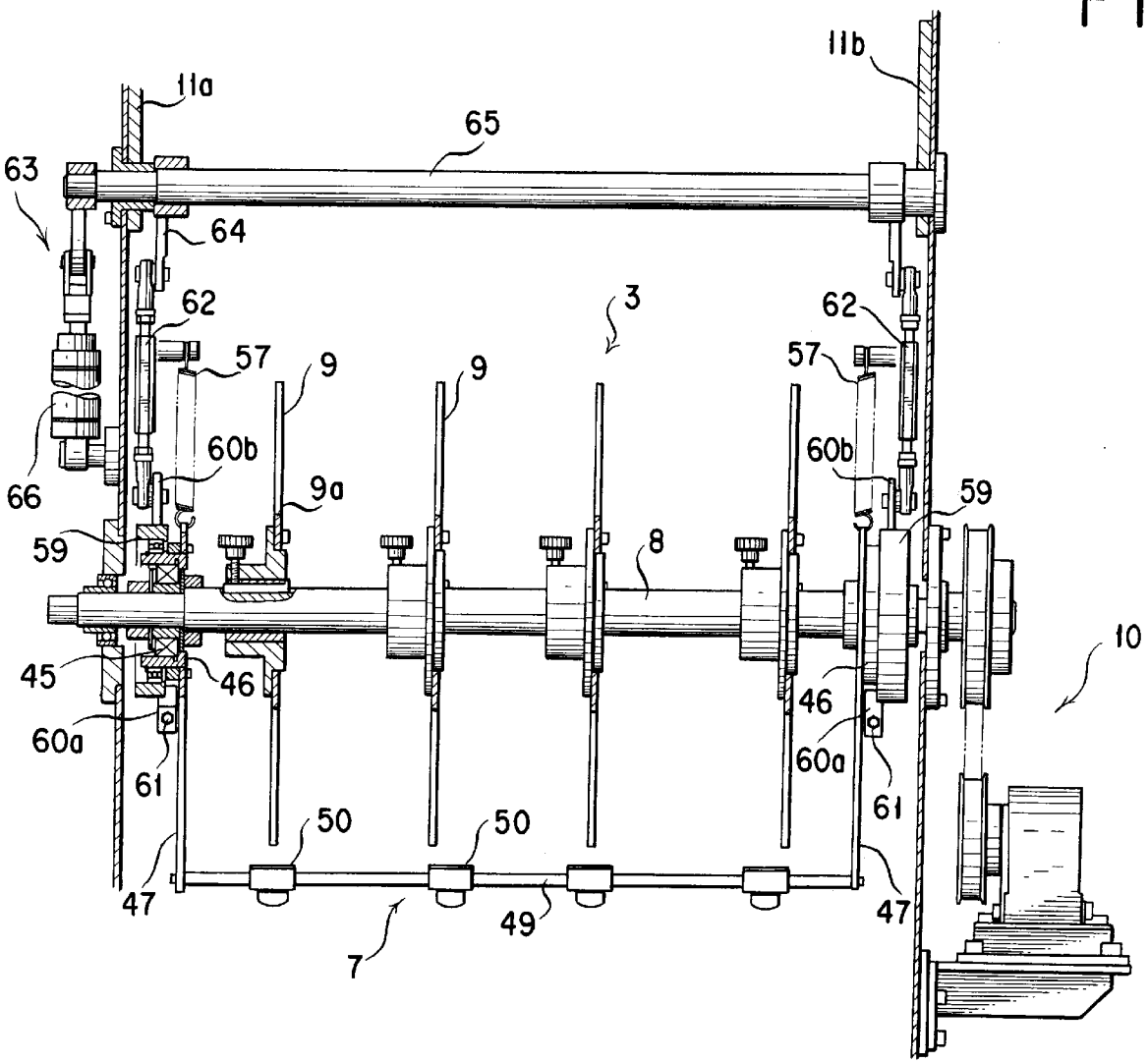
FIG. 2 is an axial section through the delivery fan of the FIG. 1 apparatus, shown together with the temporary sheet holder and other means in the neighborhood of the delivery fan.

The construction of the delivery fan 3 will be best understood from FIGS. 1 and 2. Included is a shaft 8 having its opposite ends journaled in a pair of confronting framing walls 11*a* and 11*b* of the machine for rotation in the direction in which the sheets 2 are supplied from the overhead conveyor 1. Sets of convolute blades 9 are affixed to the shaft 8. Each set consists of four such blades, spaced axially of the shaft 8, in this particular embodiment. Further a multiplicity of such sets of blades are arranged at constant circumferential spacings 9*a* on the shaft 8.

At 10 in FIG. 2 is shown a conventional drive mechanism for the delivery fan 3. Driven at a peripheral speed just slightly less than the speed at which the sheets 2 are fed in from the conveyor 1, the delivery fan 3 receives one sheet in each spacing between its sets of blades 9.

Movable Platform

Figure 3:
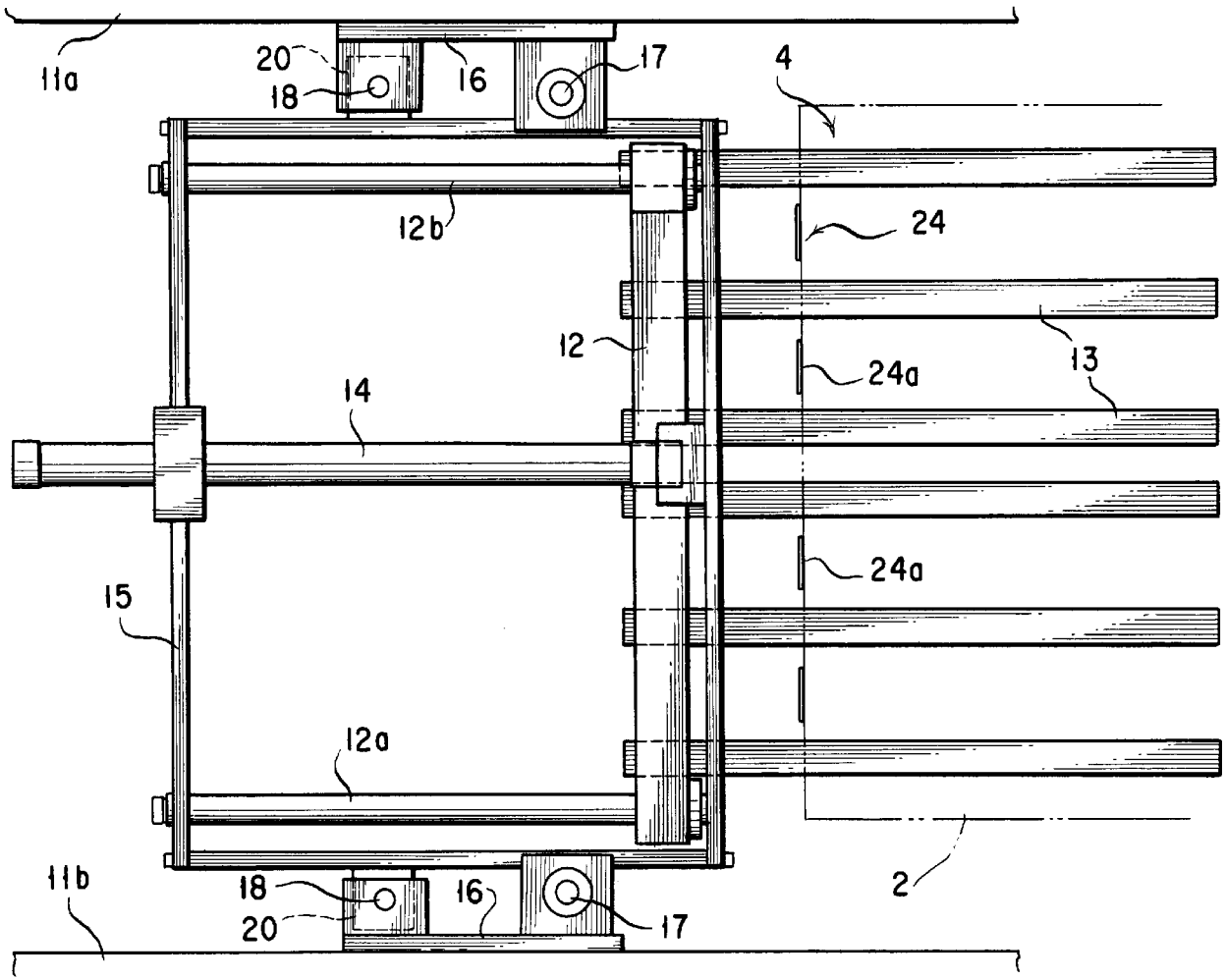
FIG. 3 is an enlarged plan view of a movable platform on which the sheets are to be stacked before being unloaded on a delivery conveyor, the platform being here shown together with means for horizontally moving the same between two required positions.
Figure 4:
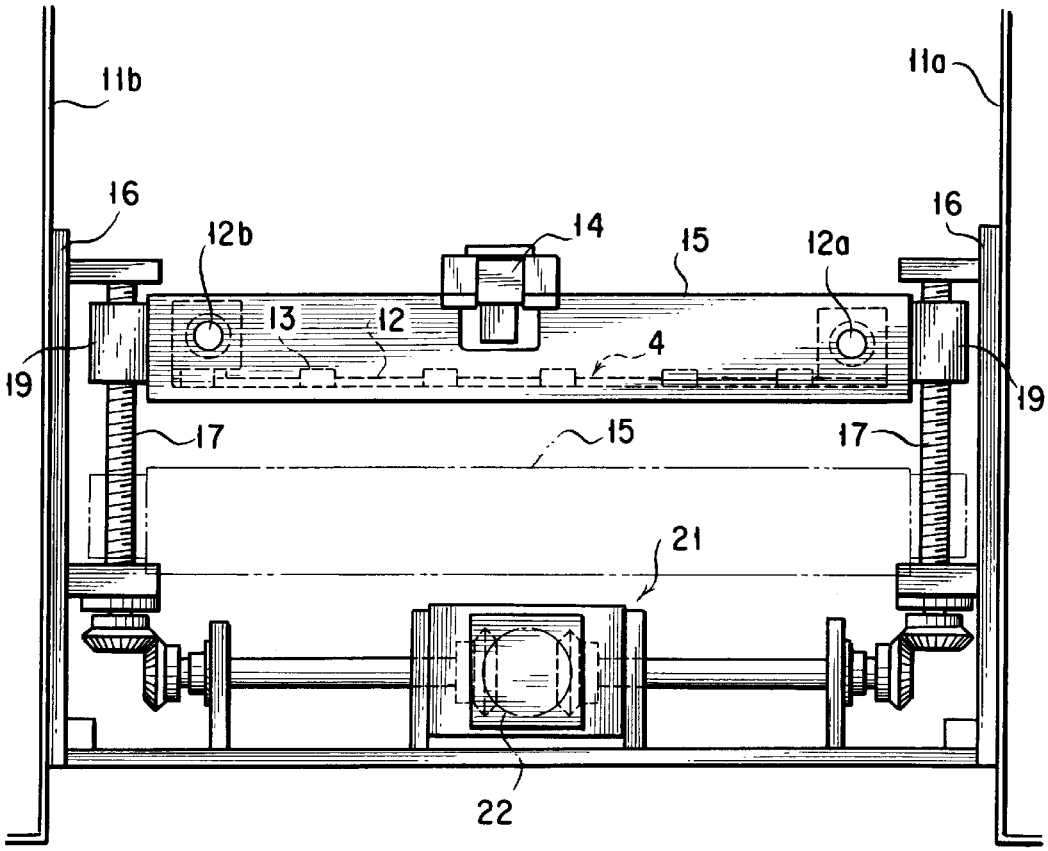
FIG. 4 is an elevation of means for vertically moving the FIG. 3 platform between two required positions.

Reference may be had to FIGS. 1, 3 and 4 for a consideration of the movable platform 4 together with its supporting and actuating means. The platform 4 is shown to be composed of a plurality of tines 13 extending in parallel spaced relationship to one another in a direction at right angles with the axis of the delivery fan 3 and all cantilevered to a yoke 12. The yoke 12 together with the tines 13 is movable horizontally, and longitudinally of the tines, along a pair of guide rods 12*a* and 12*b*. A linear actuator shown as a rodless cylinder 14 is provided for such horizontal travel of the platform 4.

The platform 4 is movable not only horizontally but vertically, too. Toward this latter end the platform 4 as well as the guide rods 12*a* and 12*b* and the linear actuator 14 is mounted to a carriage 15 in the form of a rectangular frame. A pair of upstanding supports 16 are secured to the opposed inside surfaces of the noted pair of framing walls 11*a* and 11*b* for supporting a pair of upstanding lead screws 17 and a pair of upstanding guide rods 18. The carriage 15 has on its opposite sides a pair of internally threaded lugs 19 in threaded engagement with the lead screws 17, and a pair of hollow lugs 20 in sliding engagement with the guide rods 18.

At 21 in FIG. 4 are seen drive means for joint rotation of the pair of lead screws 17 in the same direction. The drive means 21 include a bevel gearing 22 disposed midway between the pair of framing walls 11*a* and 11*b* and drivingly coupled to the lead screws 17. Thus, with the synchronous, bidirectional rotation of the lead screws 17, the carriage 15 travels up and down between the solid-line and the phantom positions of FIG. 4.

The stroke of the linear actuator 14 is such that the platform 4 travels between the position of FIG. 1, just under the delivery fan 3 and over the delivery conveyor 5 for receiving the sheets 2 falling therefrom, to a position displaced to the left, as viewed in FIGS. 1 and 3, from under the delivery fan. The up-and-down stroke of the carriage 15 with respect to the lead screws 17 is such, moreover, that the platform 4 travels between the solid-line position of FIG. 1, in which the platform is nearly on a level with the upper flight of the delivery conveyor 5, and the phantom position closer to the delivery fan 3.

Thus, by being made movable both horizontally and vertically as above, the platform 4 can cyclically assume the following four positions:

1. An initial position, indicated by the phantom outline in FIG. 1, under and close to the delivery fan 3, from which the platform 4 is to descend at the same rate as the sheets 2 are stacked thereon.

2. An unloading position, indicated by the solid lines in FIG. 1, spaced downwardly from the initial position for unloading the stack of sheets on the delivery conveyor 5.

3. A retracted position horizontally displaced upstream of the delivery conveyor 5, or to the left as viewed in FIG. 1, from the unloading position.

4. A standby position spaced upwardly from the retracted position, to the same height as the initial position, ready to be thrust horizontally back to the initial position.

Adjustable Stacking Guide Means

With continued reference to FIG. 1 the adjustable stacking guide means 6 comprise a leading end guide 24 for guiding the leading ends of the sheets 2 as they fall from the delivery fan 3 down onto the movable platform 4 or on the temporary sheet holder 7, and a trailing end guide 25 for guiding the trailing ends of the sheets down from the delivery fan. The leading end guide 24 serves further as an abutment to be hit by the sheets 2 being carried by the delivery fan 3, in order to arrest the angular travel of the sheets and hence to cause the same to be released from the fan with its continued rotation.

As depicted in FIG. 3, the leading end guide 24 is composed of a set of tines 24*a*, which are arranged interdigitatingly with the blades 9 of the delivery fan 3 and with the tines 13 of the platform 4. All the leading end guide tines 24*a* are affixed to a yoke 26, FIG. 1, which is coupled fast to one end of a connecting rod 28 slidably extending through a stationary part 27 of the machine for longitudinal displacement in a horizontal direction at right angles with the axis of the delivery fan 3. The other end of the connecting rod 28 is secured to a carriage 30 which makes threaded engagement with a lead screw 31 for travel in sliding contact with a guide rod 29. The lead screw 31 is coupled to a drive motor, not shown, via a worm gearing 32, thereby to be driven bidirectionally. Therefore, with the bidirectional rotation of the lead screw 31, the carriage 30 will travel back and forth along the same. The position of the leading end guide 24 is thus horizontally adjustable relative to the delivery fan 3, in order that the sheets 2 may hit the guide in an optimum position to be disengaged from the delivery fan and deposited on the platform 4 or on the temporary sheet holder 7.

As indicated also in FIG. 1, the trailing end guide 25 is divided into an openable bottom section 25*a* and an unopenable top section 25*b*, both normally held in vertical alignment. Both sections 25*a* and 25*b* are jointly adjustably movable horizontally in the longitudinal direction of the delivery conveyor 5, and the bottom section 25*a* is additionally openable, that is, movable both upwardly and downstream of the delivery conveyor, from the solid-line to the phantom position in FIG. 1.

For such joint horizontal travel of the trailing end guide sections 25*a* and 25*b*, there is provided a carriage 33 in threaded engagement with a lead screw 34 for sliding movement along a horizontal guide rod 33*a*. The lead screw 34 is coupled to a drive motor, not shown, via a worm gearing 35 thereby to be driven bidirectionally. The carriage 33 has a pair of mounting plates 36, one seen, of triangular shape secured to its opposite sides for immovably carrying the top section 25*b* of the trailing end guide 25 in an upstanding attitude.

A pair of carriers 37, one seen, are also mounted to the opposite sides of the carriage 33 for carrying the bottom section 25*a* of the trailing end guide 25. Driven by a fluid-actuated cylinder 38 on the carriage 33, the carriers 37 are constrained to travel relative to the carriage along tracks that decline downwardly as they extend upstream of the delivery conveyor 5.

It is now apparent that the trailing end guide 25 as a whole is adjustably movable with the motor-driven carriage 33 longitudinally of the delivery conveyor 5. The bottom guide section 25*a is* further independently movable upwardly and downstream of the delivery conveyor 5 upon contraction of the cylinder 38, for providing an exit for the stack of sheets on the delivery conveyor.

Temporary Sheet Holder

Figure 5:
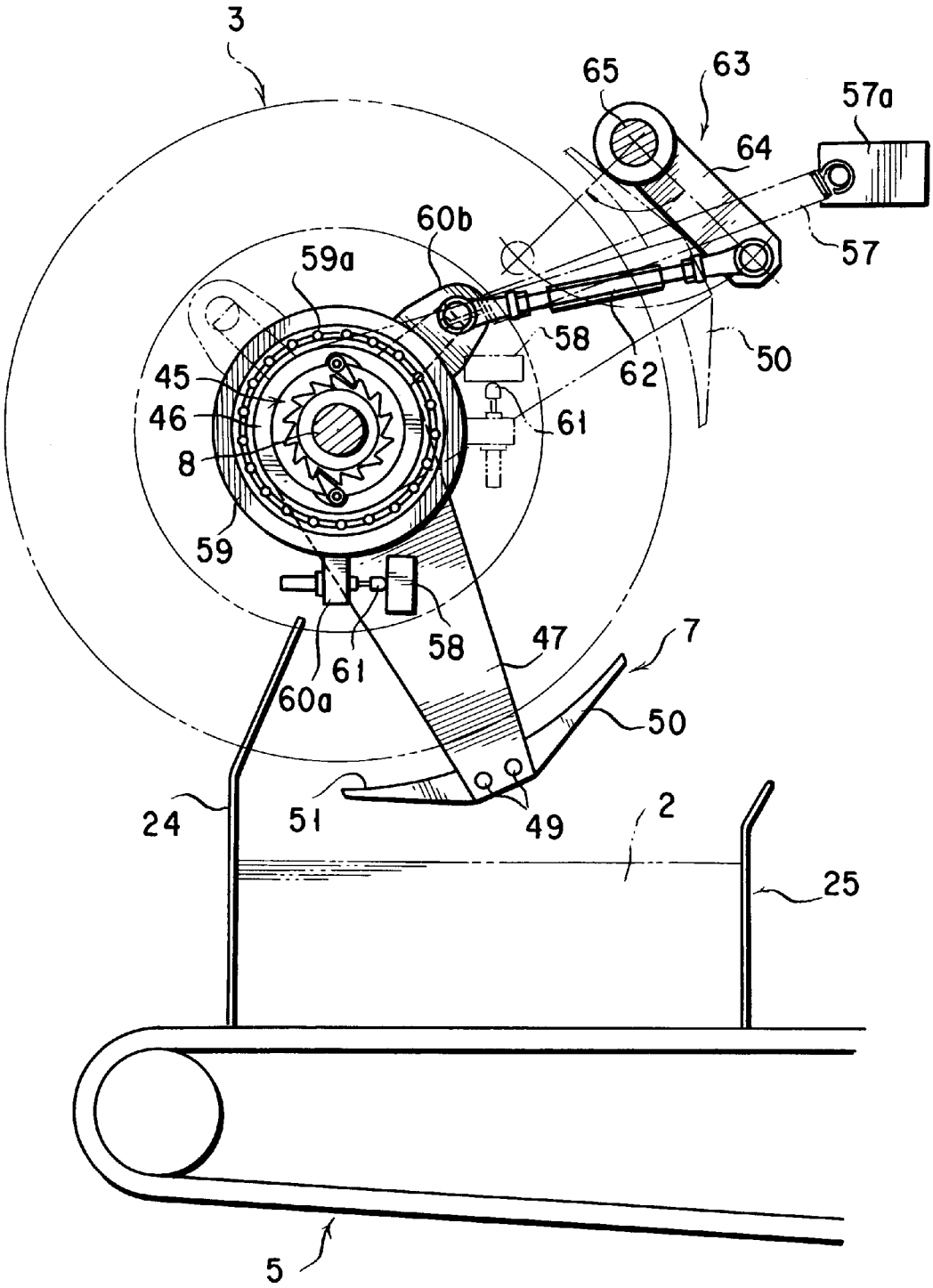
FIG. 5 shows partly in section and partly in elevation, how the temporary sheet holder is mounted to the delivery fan shaft and how it is driven between the working and retracted positions.
Figure 7:
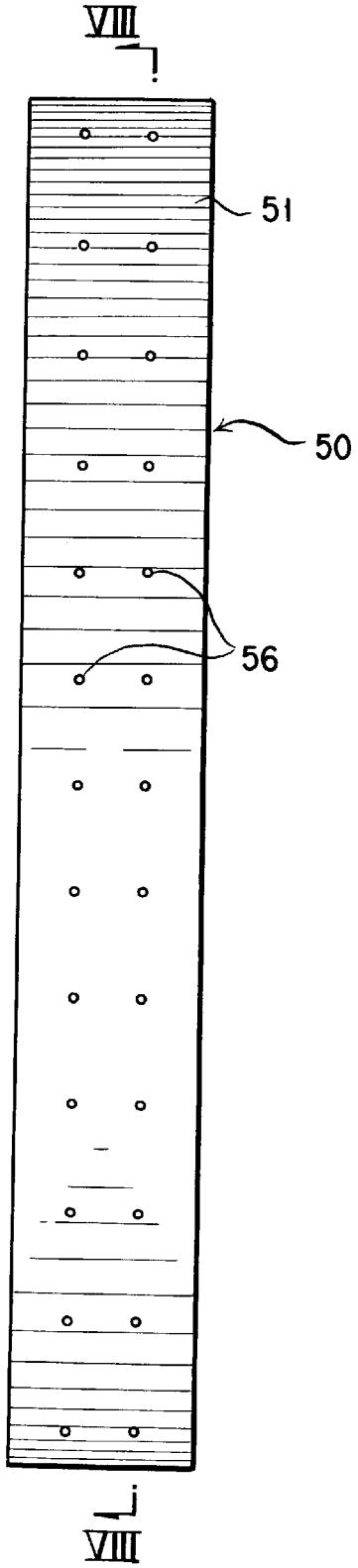
FIG. 7 is an enlarged elevation of each sheet holder prong, particularly showing the air exit openings formed in its inside surface facing the delivery fan.
Figure 8:
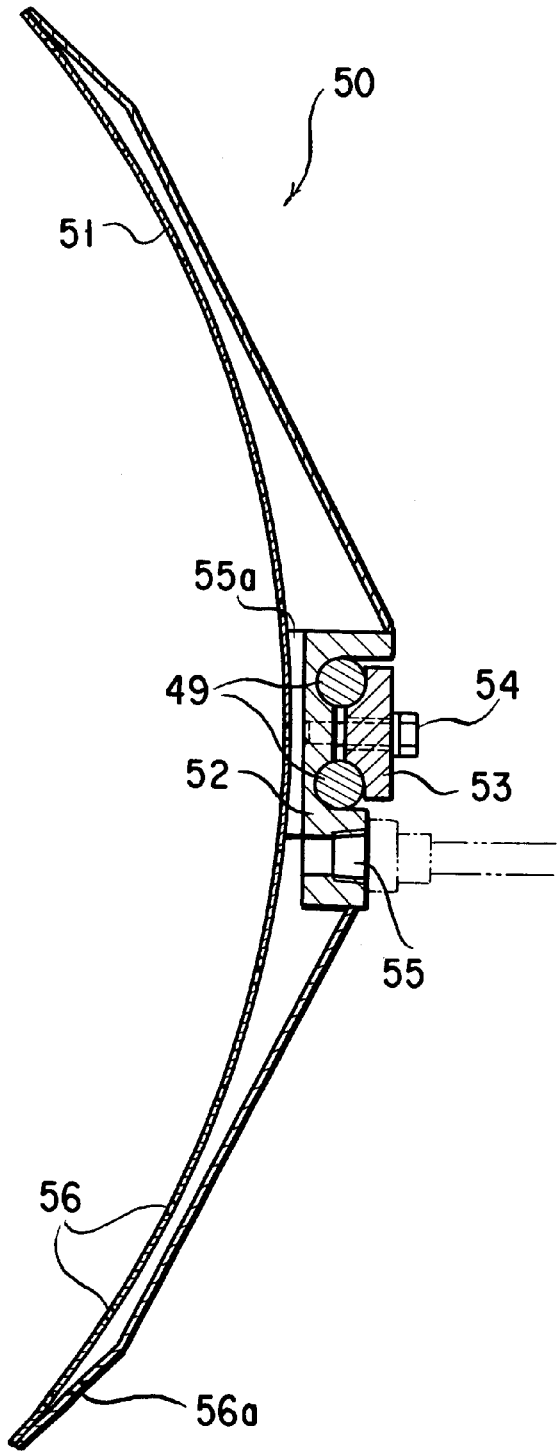
FIG. 8 is a section through the sheet holder prong, taken along the line VIII—VIII in FIG. 7.
Figure 9:
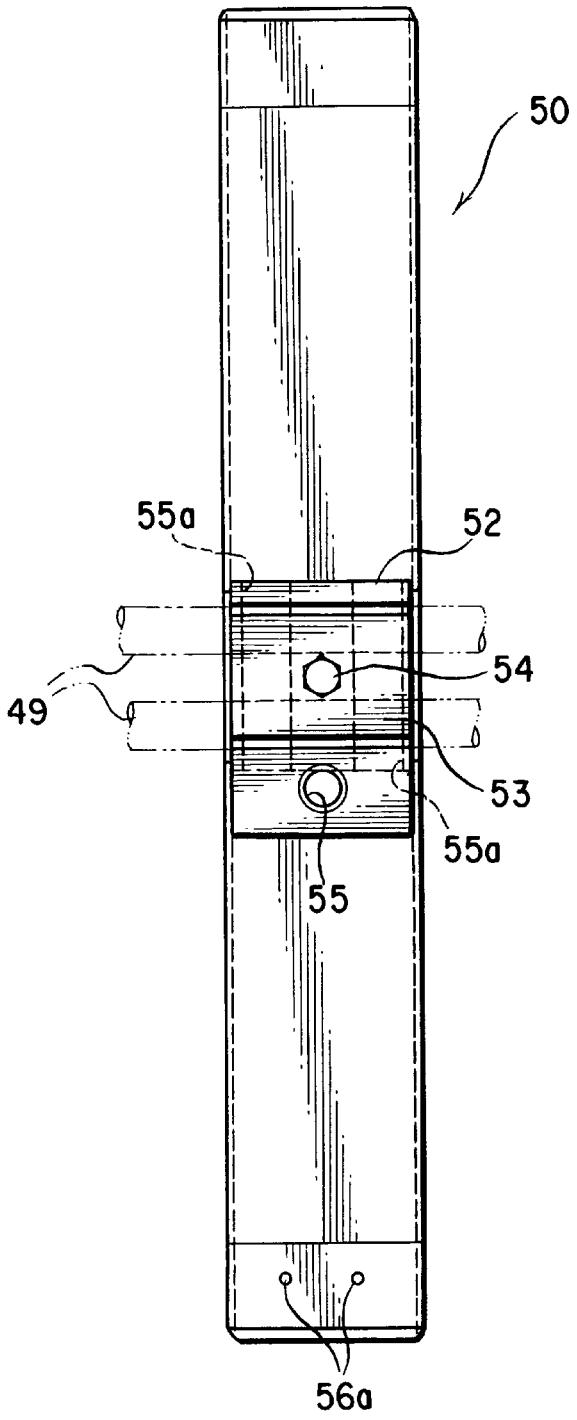
FIG. 9 is an elevation showing the outer side of the FIG. 7 sheet holder prong.

The temporary sheet holder 7 and its associated mounting and actuating means, all forming the gist of the instant invention, are best depicted in FIG. 5, although the sheet holder itself appears also in FIGS. 1 and 2 and in more detail in FIGS. 7–9. The temporary sheet holder 7 is angularly displaceable about the axis of the delivery fan 3 between the working position indicated by the solid lines in FIG. 5 and the retracted position indicated by the broken lines in the same figure. The retracted position is spaced upstream from the working position with respect to the rotational direction of the delivery fan 3, which is clockwise as viewed in this figure.

The temporary sheet holder 7 includes a pair of swing arms 47 which are proximally secured respectively to a pair of carrier rings 46. These carrier ring 46 are concentrically mounted on the rotary shaft 8 of the delivery fan 3 via respective overrunning clutches 45 of familiar make which prevent the carrier rings from running faster than the delivery fan shaft in the rotational direction of the delivery fan, and which allow the carrier rings to run freely in the opposite direction. Thus the complete sheet holder 7 is prevented from turning faster than the delivery fan 3 from its retracted to its working position but is free to run independently of the delivery fan from its working to its retracted position Extending between the distal ends of the swing arms 47 are a pair of carrier rods 49 which are situated radially outwardly of the delivery fan 3 for carrying a plurality, four shown in FIG. 2, of sheet holder prongs 50 in longitudinally spaced positions thereon. Each sheet holder prong 50 is elongated circumferentially of the delivery fan 3. Preferably, the sheet holder prongs 50 should be so mounted to the carrier rods 49 as to be both readily dismountable and adjustably movable longitudinally of the carrier rods. The sheet holder prongs 50 have inside surfaces 51 which are spaced from the delivery fan 3 and which are arched concentrically with the delivery fan, with a radius of curvature more or less equal to that of the delivery fan.

As pictured on an enlarged scale in FIGS. 7–9, each sheet holder prong 50 is hollow and, as seen in a longitudinal section as in FIG. 8, thickest as its midportion, tapering toward both extremities. The thickest midportion of each sheet holder prong 50 is formed to include a boss 52 for engagement with the pair of carrier rods 49. A clamp 53 is screwed at 54 to the boss 52 for fastening the sheet holder prong 50 to the carrier rods 49. It will be appreciated that, so clamped and screwed to the carrier rods 49, each sheet holder prong 50 is readily mountable to, and dismountable from, these rods and further independently adjustably movable along the same.

The boss 52 has formed therein an air intake port 55 which is open to the interior of the hollow sheet holder prong 50. A source of air under pressure, not shown, communicates with the ports 55 of all the sheet holder prongs 50 via suitable piping and valving. The boss 52 has a pair of air passageways 55*a* formed therethrough for intercommunicating the plenum chambers on both sides thereof.

FIG. 7 reveals a multiplicity of air exit openings 56 formed in the inside surface 51 of each sheet holder prong 50. Additionally, one or more, two shown at 56*a* in FIG. 9, air exit openings are formed in the outer surface of each sheet holder prong 50 in the adjacency of its downstream end with respect to the direction of rotation of the delivery fan 3.

It has been stated in conjunction with FIG. 5 that the pair of carrier rings 46 carrying the swing arms 47 of the temporary sheet holder 7 are mounted on the delivery fan shaft 8 via the pair of overrunning clutches 45. A helical tension spring 57 extends between each carrier ring 46 and a stationary part 57*a* of the machine for urging the carrier ring in the rotational direction of the delivery fan 3. The complete sheet holder 7 is thus sprung in that direction.

With reference to both FIGS. 2 and 5 a pair of positioning rings 59 are rotatably mounted respectively on the carrier rings 46 via bearings 59*a* for positioning the sheet holder 7 in the solid-line working position and broken-line retracted position of FIG. 5. Each positioning ring 59 has two lugs 60*a* and 60*b* formed in circumferentially spaced positions thereon and projecting radially outwardly therefrom. The first lug 60*a* carries a stop 61, preferably with a shock-absorbing capability, for abutting engagement with an abutment 58 on each swing arm 47 of the sheet holder 7. The second lug 60*b* on each positioning ring 59 is coupled to a drive mechanism 63 for jointly turning the pair of positioning rings between the two angular positions indicated respectively by the solid lines and the phantom outlines in FIG. 5. It will be noted from this figure that the second lug 60*b* is operatively coupled via an adjustable length link 62 to a swing arm 64 which is mounted fast on a rotary shaft 65 for swinging through an angle of approximately 90 degrees with the bidirectional rotation of the shaft 65.

FIG. 2 best reveals that the shaft 65, a part of the drive mechanism 63 for the positioning rings 59, has its opposite ends rotatably journaled in the pair of framing walls 11*a* and 11*b*. One of the end journals of the shaft 65 extends outwardly of the wall 11*a* and is operatively coupled to a double-acting, fluid-actuated cylinder 66.

Figure 6:
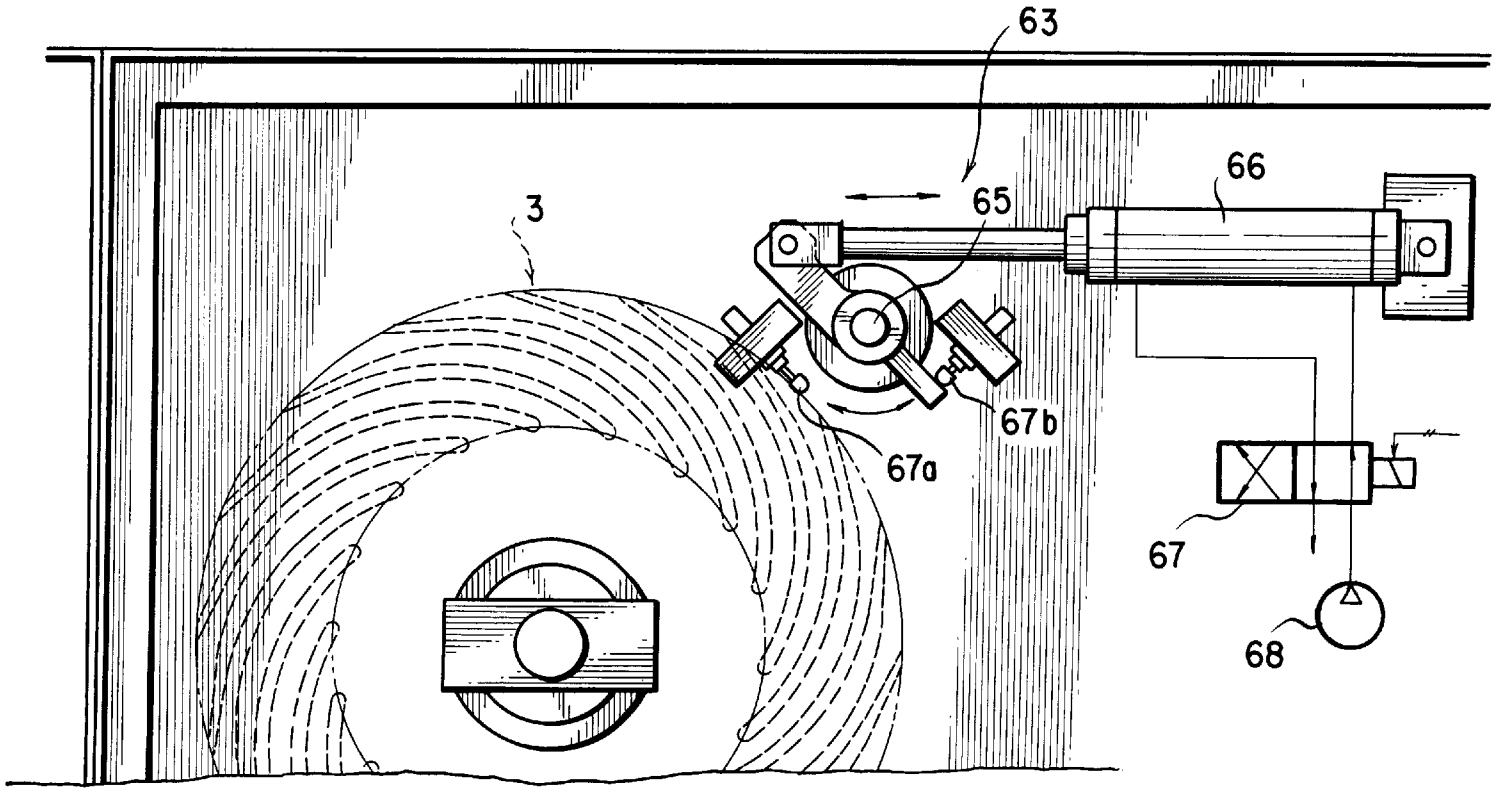
FIG. 6 is a diagrammatic illustration of part of the drive means for the temporary sheet holder.

As shown on an enlarged scale in FIG. 6, the cylinder 66 is an air cylinder, having its pair of air chambers selectively placed in and out of communication with a source 68 of air under pressure via a solenoid-operated valve 67. Also shown in this figure are a pair of limit stops 67*a* and 67*b*, both complete with shock absorbing means, for arresting the bidirectional rotation of the shaft 65 in desired angular positions.

It is understood that the stop 61 on the first lug 60*a* of each positioning ring 59 is in the solid-line position of FIG. 5, retaining the temporary sheet holder 7 in its working position under the bias of the tension springs 57, when the cylinder 66 is contracted. Upon extension of the cylinder 66, on the other hand, the pair of positioning rings 59 will turn counterclockwise, as viewed in FIG. 5, thereby causing, via the stops 61 acting on the abutments 58 on the swing arms 47, the temporary sheet holder to turn in the same direction to the phantom retracted position of the same figure in opposition to the bias of the tension springs 62.

Operation

Initially, the temporary sheet holder 7 may be held retracted away from under the delivery fan 3. The platform 4 may be held in the noted initial position indicated in phantom outline in FIG. 1.

Issuing one by one from the frictional belt conveyor 1, the sheets 2 will be successively received one in each of the spacings 9*a* between the sets of blades 9 of the delivery fan 3 which is in constant speed rotation. The sheets 2 will turn with the delivery fan 3 into abutment against the leading end guide 24 thereby to be relatively expelled from between the blades 9 with the continued rotation of the delivery fan 3. Falling down the leading end guide 24, the sheets 2 will be successively deposited and stacked on the platform 4. As the stack builds up, the platform 4 will be lowered at a matching speed toward the unloading position on the delivery conveyor 5.

When a prescribed number of sheets are stacked on the platform 4, as detected by a counter, not shown, the solenoid valve 67, FIG. 6, is to be actuated automatically to cause contraction of the air cylinder 66. Thereupon the pair of positioning rings 59 will turn in the same direction as the delivery fan 3 but at a higher speed, bringing the pair of stops 61 from its broken-line to its solid-line position in FIG. 5. So far restrained in the broken-line retracted position by the stops 61, the temporary sheet holder 7 is now free to turn clockwise to its solid-line working position under the bias of the tension springs 57.

However, the temporary sheet holder 7 is incapable of turning faster than the delivery fan 3, because its pair of swing arms 47 are secured to the carrier rings 46 which in turn are mounted on the delivery fan shaft 8 via the overrunning clutches 45. Consequently, urged by the tension springs 57, the temporary sheet holder 7 will revolve at the same angular velocity as the delivery fan 3, to the working position in which the abutments 58 on the swing arms 47 reengage the stops 61 on the positioning rings 59.

On being so driven to the working position, the temporary sheet holder 7 will have its set of prongs 50 placed under the delivery fan 3 to receive the sheets subsequently released therefrom. It is understood that air under pressure is being supplied into all the sheet holder prongs 50 at this time, the air outflowing through the openings 56, FIG. 7, in the complete inside or upper surface of each prong and through the openings 56*a*, FIG. 9, in the leading end portion of its outside or lower surface. The sheet holder prongs 50 will smoothly enter and travel between any two of the successive sheets falling from the delivery fan 3, as the airstreams issuing therefrom spread them apart. The sheets subsequently released from the delivery fan 3 will be temporarily deposited and stacked on the temporary sheet holder 7.

In the meantime the platform 4 will be pulled back from its unloading position to the retracted position past the leading end guide 24, leaving the stack of sheets on the delivery conveyor 5. Now the bottom half 25*a* of the trailing end guide 25 may be opened by contraction of the cylinder 38, and the delivery conveyor 5 set into operation, for carrying the stack of sheets to the next station. The top half 25*b* of the trailing end guide 25 will stay unmoved and so serve to guide the trailing ends of the sheets falling upon the temporary sheet holder 7.

While the temporary sheet holder 7 is receiving the sheets from the delivery fan 3, the platform 4 will be raised from its retracted to its standby position, and thence back to its initial position just under the sheet holder being held in its working position. Then the cylinder 66, FIG. 6, of the positioning ring drive mechanism 63 will be extended, causing, via the adjustable length links 62, the pair of positioning rings 59 to turn counterclockwise, as viewed in FIG. 5, a direction opposite to the rotational direction of the delivery fan 3. The stops 61 on the lugs 60*a* of the positioning rings 59 will then act on the abutments 58 of the swing arms 47 of the temporary sheet holder 7, causing angular displacement of this sheet holder from its solid-line working position to its broken-line retracted position, both shown in FIG. 5. Upon such angular retraction of the sheet holder 7, the sheets that have been stacked thereon will fall down onto the platform 4.

At this time, too, air under pressure is being emitted through the openings 56 in the complete inside surfaces of the sheet holder prongs 50. The stack of sheets on the sheet holder 7 will therefore not stick to these surfaces but will smoothly fall off onto the platform 4.

Thereafter the foregoing cycle of operation will be repeated to form another stack on the platform 4, as the platform 4 is lowered in step with the gradual buildup of the sheet stack thereon. The openable bottom half 25*a* of the trailing end guide 25 has been closed by this time, so that the sheets falling upon the platform 4 will be guided by both guides 24 and 25. It is understood that a pair of side guides, not shown, are provided in combination with the end guides 24 and 25 for guiding the lateral sides of the sheets as well. The foregoing disclosure of the preferred embodiment is meant purely to illustrate or explain and not to impose limitations upon the invention. A variety of modifications, alterations and adaptations of the embodiment will suggest themselves to one skilled in the art without departing from the scope of the invention as expressed in the claims which follow.

What is claimed is:

1. An apparatus for delivery of sheets of paper or like material in successive stacks, comprising:

(a) infeed means for successively supplying sheets to be delivered;

(b) a delivery fan comprising a rotary shaft, and a plurality of sets of blades disposed at constant circumferential spacings on the shaft for receiving therebetween the successive sheets from the infeed means, the delivery fan being capable of rotation in a prescribed direction;

(c) abutment means to be hit by the successive sheets being carried by the delivery fan, the sheets on hitting the abutment means falling off the delivery fan with continued rotation thereof;

(d) delivery means underlying the delivery fan for receiving and having stacked thereon the sheets successively falling off the delivery fan;

(e) a temporary sheet holder angularly displaceable about the same axis as the delivery fan between a working position, where the temporary sheet holder temporarily receives the sheets falling off the delivery fan pending replacement of a preformed stack of sheets on the delivery means, and a retracted position where the temporary sheet holder allows the sheets to fall from the delivery fan onto the delivery means, the retracted position being spaced upstream from the working position with respect to the prescribed direction of rotation of the delivery fan;

(f) overrunning clutch means through which the temporary sheet holder is mounted to the shaft of the delivery fan for preventing the temporary sheet holder from rotating faster than the delivery fan shaft in a direction from the retracted to the working position, and for allowing the temporary sheet holder to rotate independently of the delivery fan shaft in a direction from the working to the retracted position;

(g) resilient means acting between the temporary sheet holder and a stationary part of the apparatus for biasing the former from the retracted toward the working position and hence for causing, in cooperation with the overrunning clutch means, the temporary sheet holder to travel at the same angular velocity as the delivery fan from the retracted to the working position; and (h) drive means for moving the temporary sheet holder from the working to the retracted position against the bias of the resilient means.

2. The apparatus of claim 1 wherein the temporary sheet holder comprises a pair of swing arms having a plurality of sheet holder prongs supported therebetween, and wherein the overrunning clutch means comprises:

(a) a pair of overrunning clutches; and (b) a pair of carrier rings mounted to the shaft of the delivery fan via the respective overrunning clutches;

(c) the pair of swing arms of the temporary sheet holder being proximally secured to the respective carrier rings and supporting the sheet holder prongs between their distal ends.

3. The apparatus of claim 1 wherein the drive means comprises:

(a) a pair of positioning rings rotatably mounted to the shaft of the delivery fan;

(b) a pair of stops formed one on each positioning ring for abutting engagement with the temporary sheet holder; and (c) actuator means for bidirectionally rotating the pair of positioning rings relative to the delivery fan shaft between a first position, where the temporary sheet holder is held in the working position by being urged against the pair of stops by the resilient means, and a second position where the temporary sheet holder is held in the retracted position by being urged against the pair of stops by the resilient means.

4. The apparatus of claim 1 wherein the temporary sheet holder has a plurality of air exit openings formed therein for emitting air under pressure in order to avoid interference with the sheets falling from the delivery fan when the temporary sheet holder travels from the retracted to the working position, and to allow the sheets to fall smoothly from the temporary sheet holder onto the delivery means when the temporary sheet holder travels from the working to the retracted position.

5. The apparatus of claim 1 wherein the temporary sheet holder comprises a pair of swing arms with a plurality of sheet holder prongs supported therebetween, each sheet holder prong being hollow, defining a plenum chamber therein, and having a surface facing the delivery fan for receiving the sheets falling therefrom, and wherein a plurality of air exit openings are formed in said surface of each sheet holder prong.

6. The apparatus of claim 5 wherein at least one other air exit opening is formed in another surface of each sheet holder prong which faces away from the delivery fan.

* * * * *